US006068252A

United States Patent [19]

Komuro

[11] Patent Number: 6,068,252

[45] Date of Patent: May 30, 2000

[54] SHEET FEEDING APPARATUS

[75] Inventor: Kiyoto Komuro, Nagano, Japan

[73] Assignee: Seiko Epson Corporation, Tokyo, Japan

[21] Appl. No.: 09/085,112

[22] Filed: May 28, 1998

[30] Foreign Application Priority Data

May 29, 1997 [JP] Japan ..... 9-155999

[51] Int. Cl.[7] ..... B65H 3/40

[52] U.S. Cl. ..... 271/9.13; 271/9.11; 271/10.11; 271/264; 271/272; 271/186

[58] Field of Search ..... 271/10.01, 10.09, 271/10.11, 10.13, 225, 264, 272, 273, 9.13, 9.11, 186

[56] References Cited

U.S. PATENT DOCUMENTS 5,725,208 3/1998 Miyauchi ..... 271/10.09

FOREIGN PATENT DOCUMENTS 574041 12/1993 European Pat. Off. .
403267226 11/1991 Japan ..... 271/9.11
405000740 1/1993 Japan ..... 271/9.11
405246583 9/1993 Japan ..... 271/10.11
406107348 4/1994 Japan ..... 271/9.13
2127383 4/1984 United Kingdom ..... 271/10.09

OTHER PUBLICATIONS

Patent Abstracts of Japan, vol. 097, No. 007, Mar. 31, 1997 (Canon Inc).

*Primary Examiner*—H. Grat Skaggs
*Attorney, Agent, or Firm*—Sughrue, Mion, Zinn, Macpeak & Seas, PLLC

[57] ABSTRACT

The rear edge support rollers which protrude in the U-shaped sheet paths on the upstream side of the sheet feeding direction prevent the rear edge of the sheet from sliding in contact with the path walls and restrain back tensions from working on the main sheet feed roller while the sub-sheet feed rollers which are disposed inside the U-shaped path are imparted with the revolutionary resistances that correspond to the curvatures of the paths so as to reduce the loads which are given to the main sheet feed roller to work in the direction of forwarding the sheet by the rear edge of the sheet thrusting against the outer lateral wall due to the stiffness of the sheet.

7 Claims, 5 Drawing Sheets

SHEET FEEDING APPARATUS

BACKGROUND OF THE INVENTION

1. Field of the Invention

The present invention relates to a sheet feeding apparatus applicable to a printer, a photocopier or the like.

2. Description of the Related Art

For a printer and such apparatuses, to dispose a sheet stack part below a recording part is an advantageous measure of reduction in occupation space of the apparatuses. However, a sheet conveyance path in such a structure must be formed in a U-shape, so the following disadvantage of unfavorable influence in printing is brought about. That is, depending an stiffness of the sheet, on an upstream side of the U-shaped path, as indicated by a double-dotted dashed line in FIG. 3A, a rear edge of the sheet sliding in contact with a path wall causes a back tension in such a direction as to pull back the sheet away from a main sheet feed roller as shown as indicated by double-dotted dashed lines a1, a2 in FIG. 4.

On the other hand, after entrance of the rear edge into the U-shaped path, as indicated by a double-dotted dashed line in FIG. 3B and FIG. 4, a rear edge of the sheet in contact with and thrusting against an outer guide wall causes a tension in such a direction as forward the sheet toward the main sheet feed roller. Incidentally, the sheet feeding load in FIG. 4 indicates a value when the rear edge of the sheet is positioned at the position corresponding to the horizontal value in FIG. 4 (i.e. x-axis value).

SUMMARY OF THE INVENTION

In view of such problems as described above, on the objectives of the present invention is to provide a new sheet feeding apparatus which can apply sheet feeding load to the main sheet feed roller as uniformly as possible for all sheet positions during the conveyance process.

According to the present invention as a solution to such problems as described above, there is provided a sheet feeding apparatus in which a conveyed sheet is fed via an U-shape path into a recording part by a main sheet feed roller provided immediately before the recording part, comprising: a rear edge support roller disposed on an upstream side of the U-shaped path, the rear edge support roller rotating in accordance with transfer of the sheet and supporting a rear edge of the sheet; and a sub-sheet feed roller disposed in the U-shaped path, wherein a revolutional resistance corresponding to a curvature of the U-shaped path is provided to the sub-sheet feed roller.

In this structure, the rear edge support roller which protrudes in the sheet path on the upstream side of the sheet feeding direction prevents the rear edge of the sheet from sliding in contact with the path wall and restrains a back tension from working on the main sheet feed roller, while the sub-sheet feed roller which is disposed in the U-shaped path is provided with the revolutional resistance that corresponds to the curvature of the path so as to reduce the load which is given to the main sheet feed roller to work in the direction of forwarding the sheet by the rear edge of the sheet thrusting against the outer lateral wall due to the stiffness of the sheet.

DETAILED DESCRIPTION OF THE PREFERRED EMBODIMENTS

Figure 1:
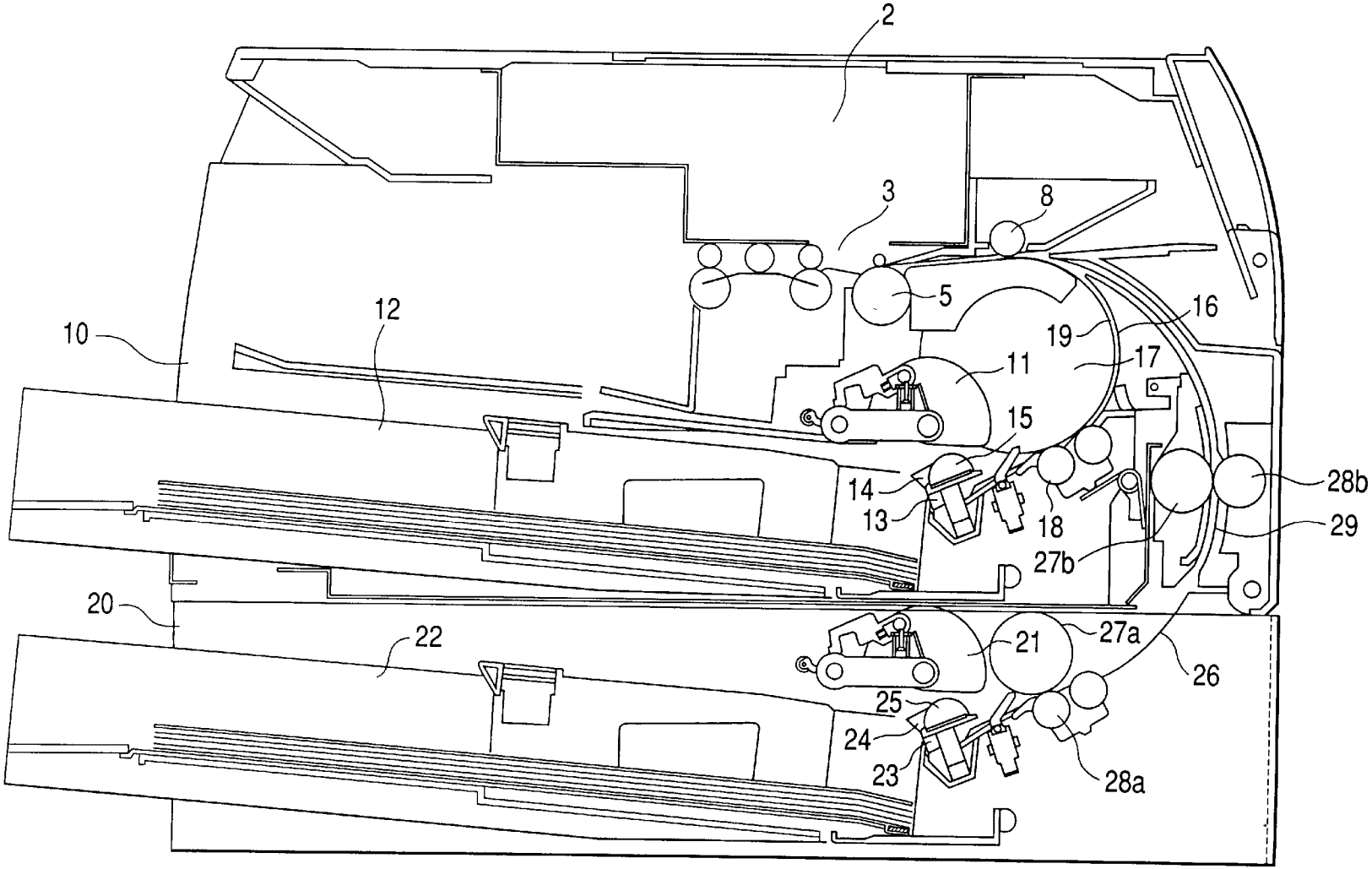
FIG. 1 shows the configuration of the apparatus as an embodiment of the present invention in a state wherein a sheet is fed to the main sheet feed roller.

An embodiment of the present invention will now be described.

All the drawings show a double-bin-type printer which comprises a sheet feeding apparatus which embodies the present invention.

First and second sheet feed mechanisms 10 and 20 are disposed vertically as shown in the drawings. The first sheet feed mechanism 10 conveys the sheet picked up from the inside of a sheet tray 12 by a pick up roller 11 to a linear sheet conveyance path 3 which leads to a recording part 2 by a sub-sheet feed roller 17 which constitutes a U-shaped path 16. The second sheet feed mechanism 20 conveys the sheet picked up from the inside of a sheet tray 22 by a pick up roller 21 to an entrance of the linear sheet conveyance path 3 which leads to the recording part 2 by sub-sheet feed rollers 27*a*, 27*b* which are respectively disposed in a U-shaped path 26.

The sheet conveyed to the linear sheet conveyance path 3 by the sheet feed mechanisms 10 and 20 is fed to the recording part 2 after the feeding speed thereof is accurately regulated by a main sheet feed roller 5 disposed immediately before the recording part 2. This sheet feed roller 5 is influenced by a difference in curvatures of the first and the second U-shaped paths 16 and 26 and by changes in the back tension at sheet conveyance process, these sheet feed mechanisms 10 and 20 are equipped with means for making the passage loads and the back tensions uniform.

Until the rear edge of the sheet reaches the sub-sheet feed rollers 17, 27*a* and 27*b*, rear edge support rollers 15 and 25 shown in the drawings support the rear edge of the sheet so as to reduce the back tension that is the load applied to the main sheet feed roller 5 when this part is in contact with the path wall. These rollers 15 and 25 are disposed so as to protrude, at the same time as the sheet is picked up, in the sheet path together with elements 14 and 24 which return second and the following sheets which are separated by separation pads 13 and 23 to the sheet trays 12 and 22.

Figure 5:
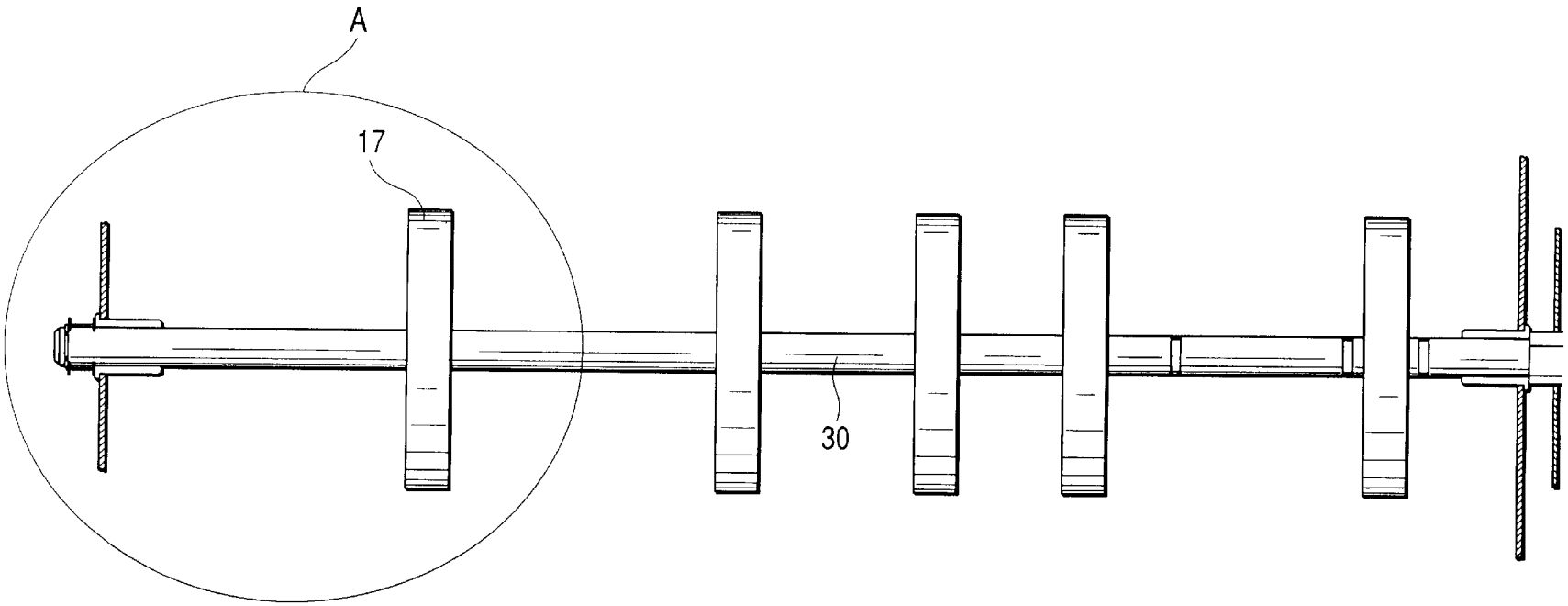
FIG. 5 is a plan view of a sub-sheet feed roller shaft.
Figure 6:
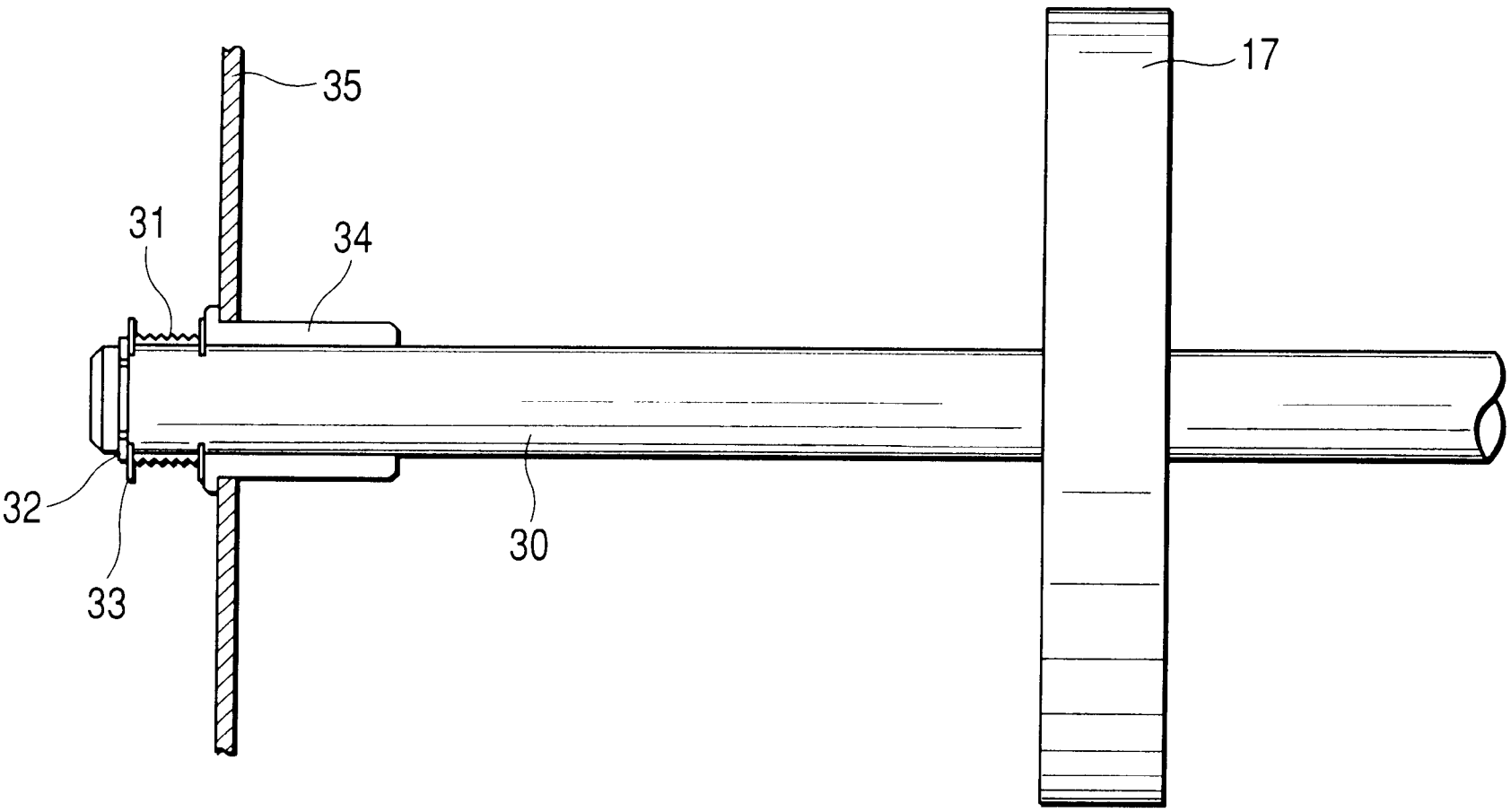
FIG. 6 is an enlarged view of A portion in FIG. 5.

On the other hand, the sub-sheet feed roller 17 which is provided in the first sheet feed mechanism 10 is driven so as to revolve at the same circumferential speed as the main sheet feed roller 5 by a sheet feed motor that is not shown in the drawings until the fore edge of the sheet reaches the main sheet feed roller 5. When the rear edge of the sheet reaches the U-shaped path 16, the driving power is stopped. At this point, the sub-sheet feed roller freely rotates and is rotated by friction of the sheet. Also, a rear edge of the sheet abuts the U-shaped path which creates a load on the main sheet roller in the direction of forwarding of the sheet. In order to prevent this, simultaneously, a coil spring 31 shown in FIGS. 5 and 6 wound around a sub-sheet feed roller shaft 30 applies such a small revolutional resistance as to revolve the sub-sheet feed roller 17 with play in order to prevent the rear edge of the sheet from coming into contact with an outer lateral wall 19 at this part and applying any load in the feeding direction to the main sheet feed roller 5. Incidentally, FIG. 6 is an enlarged view of A portion in FIG. 5, and 32 designates E-ring, 33 a plate seat, 34 a bearing. 35 is a frame for fixing the sub-sheet feed roller shaft 30.

On the other hand, the two sub-sheet feed rollers 27*a* and 27*b* which are provided at the U-shaped path 26 in the second sheet feed mechanism 20 are driven in such a manner as the circumferential speed of the sub-sheet feed roller 27*b* on the lower course side is slightly faster than that of the sub-sheet feed roller 27*a* on the upstream side but of the same circumferential speed as the main sheet feed roller 5. After the rear edge of the sheet reaches this U-shaped path 26, in the same way as in the first sheet feed mechanism 10, the revolutional driving power which operates these rollers 27*a* and 27*b* is stopped and simultaneously coil springs which are wound around these roller shafts apply such small revolutional resistances as to revolve the rollers 27*a* and 27*b*.

The revolutionary resistances by means of these coil springs are varied respectively according to the curvatures of the U-shaped paths 16 and 26, wherein the rollers 17, 27*a* and 27*b* are applied with larger revolutional resistances for larger curvatures.

Driven rollers 18, 28*a* and 28*b* which are respectively provided for the above-described sub-sheet feed rollers 17, 27*a* and 27*b* rotate in contact with the sub-sheet feed rollers 17, 27*a* and 27*b* to cooperate for sheet feeding till the fore edge of the sheet reaches the main sheet feed roller 5 and then these are separated to reduce the negative sheet feed load applied to the main sheet feed roller 5.

A driven roller 8 in the drawings comes into contact with and gets separated from the first sub-sheet feed roller 17 at a junction of the U-shaped paths.

The apparatus of the structure as described above waits first in the state wherein the driven rollers 18, 28*a* and 28*b* are respectively in contact with the sub-sheet feed rollers 17, 27*a* and 27*b* as shown in FIG. 1 and then, when either pick-up roller 11 or 21 starts to move, the sheet picked up from either corresponding sheet tray 12 or 22 is conveyed to the main sheet feed roller 5.

Figure 2:
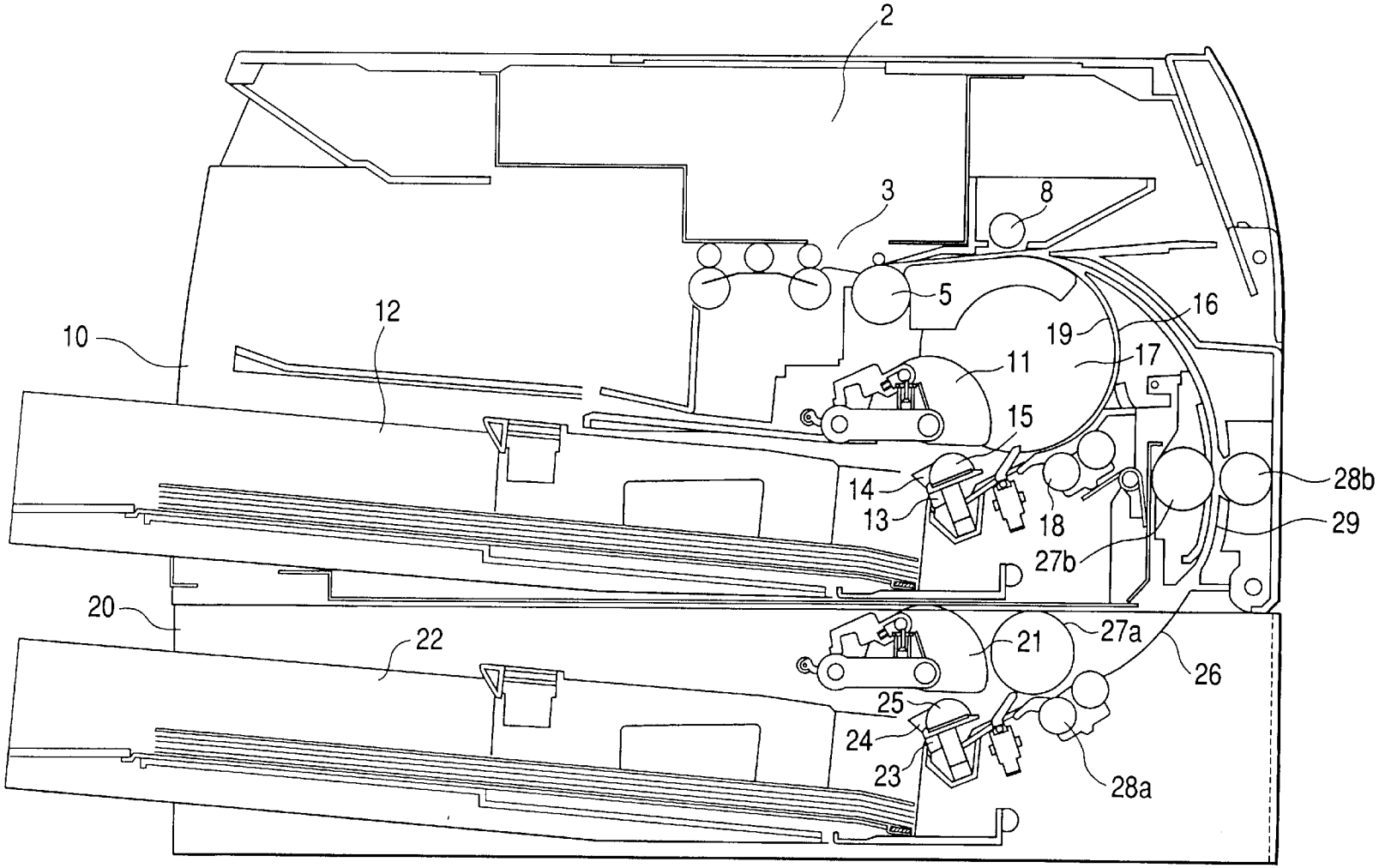
FIG. 2 shows the configuration of the same apparatus as above in a state wherein the sheet is being fed by the main sheet feed roller.

When the fore edge of the sheet is conveyed to the main sheet feed roller 5, driving power to the sub-sheet feed roller(s) 17 or 27*a* and 27*b* is stopped and simultaneously the driven roller(s) 18 or 28*a* and 28*b* is (are) separated from the sub-sheet feed roller(s) 17 or 27*a* and 27*b* as shown in FIG. 2 to terminate the sheet feeding influence which the sub-sheet feed roller(s) 17 or 27*a* and 27*b* gives to the main sheet feed roller 5.

Figure 3A:
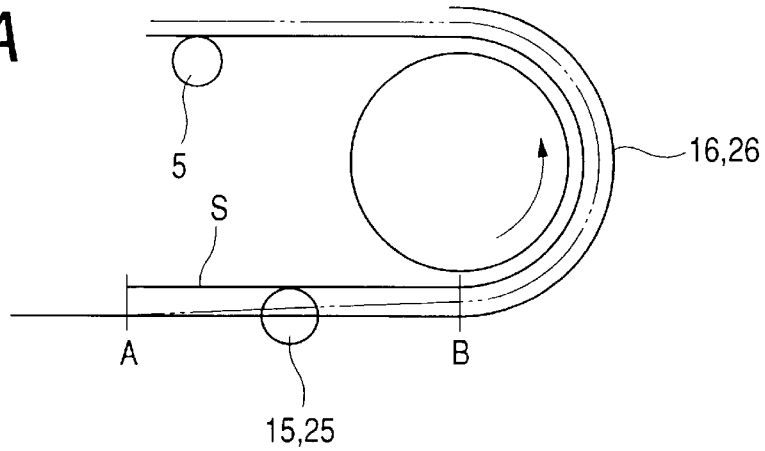
FIGS. 3A and 3B show fluctuations in the loads at respective sheet feed positions.
Figure 4:
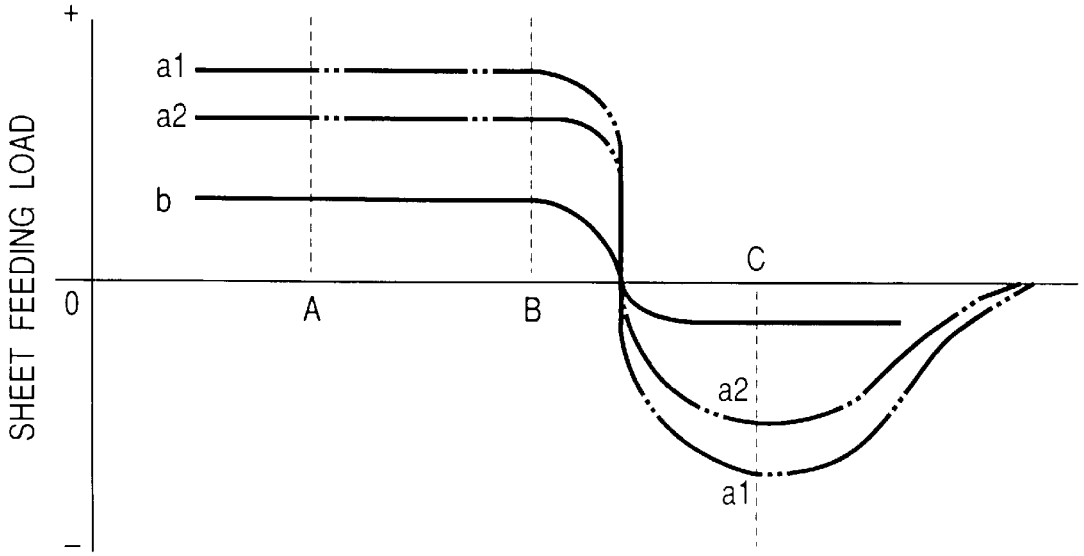
FIG. 4 shows the loads generated by the rear sheet edge at different positions in comparison with the loads after reduction thereof.

Along with this, the rear edge support roller 15 or 25 on return member 14 or 24, which protrudes in the sheet feed path as shown in FIG. 3A, supports the rear edge of the sheet S at position A on the upstream side and thus reduces the sheet pick-up load given to the main sheet feed roller 5 when the rear edge is in contact with the sheet path wall from the values indicated by double-dotted dashed lines a1 and a2 to the values indicated by a solid line b in FIG. 4.

Figure 3B:
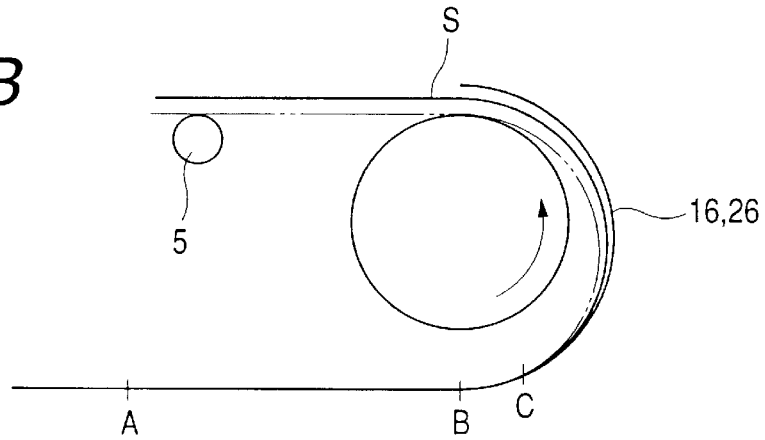

When the sheet is fed further and the rear edge thereof enters inside the U-shaped path 16 or 26 at position B, the sheet S applies load in the sheet feeding direction to the main sheet feed roller 5 since recoiling strength forces the rear edge thereof to be in an intense contact with the outer lateral wall 19 or 29 of the U-shaped path 16 or 17 at position C as shown in FIG. 3B.

This load is, as indicated by double-dotted dashed lines in FIG. 4, in proportion to the curvatures of the U-shaped paths; although load a1 at the first path 16 is larger than load a2 in the second path 26, Since the revolutional resistances which correspond to this negative load a1, a2 are applied to the respective shafts of the first and second sub-sheet feed rollers 17, 27*a* and 27*b* by coil springs in advance as described above, the sheet S comes into contact with the sub-sheet feed roller(s) 17 or 27*a* and 27*b* when the sheet S passes through the U-shaped path 16 or 26, the load is offset by the revolutional resistance(s) of the spring(s) and thus, as shown by the solid line b in FIG. 4, the load applied to the main sheet feed roller 5 is reduced so far as possible.

Although the present invention is explained with utilization of the printer which comprises two sheet feed mechanisms 10 and 20, the invention is applicable to a printer or a photocopier equipped with further more sheet feed mechanisms.

In accordance with the present invention, as discussed above, since the rear edge support roller (15 or 25) which supports the rear edge of the sheet is provided so as to protrude in the U-shaped path (16 or 26) on the upstream side of the path while such revolutional resistance as corresponds to the curvature of the path is provided to the sub-sheet feed roller (17, 27*a* or 27*b*) which is disposed in the U-shaped path, this support roller can reduce the sheet feed load that is generated by the rear edge of the sheet sliding in contact with the path wall before entrance into the U-shaped path. And inside the U-shaped path, since the load in the sheet feeding direction, which is generated by the rear edge of the sheet thrusting against the outer lateral wall with the recoiling strength, can be offset by the revolutional, resistance applied to the sub-sheet feed roller; the sheet feed roller immediately before the recording part can perform accurate and stable sheet feed movements.

Additionally, since such revolutional resistances as in proportion to the curvatures of the paths are provided respectively to the sub-sheet feed rollers which are disposed in the U-shaped paths that lead to a common main sheet feed roller, the loads in the sheet feeding direction which are varied by the curvatures of the paths can be regulated uniformly.

What is claimed is:

1. A sheet feeding apparatus in which a conveyed sheet is fed via a U-shape path into a recording part by a main sheet feed roller provided immediately before the recording part, comprising:

a rear edge support roller disposed on an upstream side of the U-shaped path, said rear edge support roller rotating in accordance with transfer of the sheet and supporting a rear edge of the sheet;

a sub-sheet feed roller disposed in the U-shaped path on a sub-sheet roller shaft; and a coil spring wound around said sub-sheet feed roller shaft which applies a revolutional resistance to said sub-sheet feed roller in order to prevent the sheet from applying a load to said main sheet roller.

2. The sheet feeding apparatus according to claim 1, wherein said rear edge support roller protrudes in a path on the upstream side of the U-shaped path and prevents a rear edge of the sheet from sliding in contact with a wall of said U-shaped path.

3. The sheet feeding apparatus according to claim 1, wherein said revolutional resistance is proportional to a curvature of said U-shaped path.

4. A sheet feeding apparatus comprising:

a common main sheet feed roller, a plurality of U-shaped paths joining to said common main sheet feed roller;

a plurality of sub-sheet feed rollers, each of said sub-sheet feed rollers being disposed in a respective U-shaped path of said plurality of U-shaped paths and on a respective one of said plurality of sub-sheet roller shafts; and a coil spring wound around each one of said sub-sheet feed roller shafts which applies a revolutional resistance to a respective one of said plurality of sub-sheet feed rollers in order to prevent the sheet from applying a load to said common main sheet roller.

5. The sheet feeding apparatus according to claim 4, wherein said revolutional resistance applied by each of said coil springs is proportional to a curvature of a respective one of said U-shaped paths.

6. A sheet feeding apparatus in which a conveyed sheet is fed via a U-shape path into a recording part by a main sheet feed roller provided immediately before the recording part, comprising:

a rear edge support roller disposed on an upstream side of the U-shaped path, said rear edge support roller rotating in accordance with transfer of the sheet and supporting a rear edge of the sheet;

a sub-sheet feed roller disposed in the U-shaped path on a sub-sheet roller shaft; and means for applying a revolutional resistance to said sub-sheet feed roller to rotate said sub-sheet feed roller and prevent said sheet from applying a load to said main sheet roller.

7. The sheet feeding apparatus according to claim 6, wherein said revolutional resistance is proportional to a curvature of said U-shaped path.

* * * * *